US005328140A

United States Patent [19]

Wong

[11] Patent Number: 5,328,140

[45] Date of Patent: Jul. 12, 1994

[54] DEVICE FOR HANGING FRAMES

[76] Inventor: Yin H. Wong, 158 Jalan Dato Sulaiman Century Garden, Johor Bahru West Malaysia 80250, Malaysia

[21] Appl. No.: 926,411

[22] Filed: Aug. 10, 1992

[30] Foreign Application Priority Data

Aug. 8, 1991 [GB] United Kingdom ..... 9117169
Mar. 16, 1992 [GB] United Kingdom ..... 9205668

[51] Int. Cl.[5] ..... A47G 1/16
[52] U.S. Cl. ..... 248/493; 248/498
[58] Field of Search ..... 248/489, 493, 494, 497, 248/498, 475.1, 301; 40/152.1

[56] References Cited

U.S. PATENT DOCUMENTS

| | | | |
|---|---|---|---|
| 1,433,178 | 10/1922 | Chase | 248/493 |
| 1,478,461 | 12/1923 | Underwood | 248/489 |
| 2,317,368 | 4/1943 | Frey | 248/493 |
| 3,226,065 | 12/1965 | Smith | 248/493 |
| 3,912,211 | 10/1975 | Topf | 248/489 |
| 3,982,719 | 9/1976 | Kilborne | 248/489 |
| 4,026,510 | 5/1977 | Holmes | 248/493 |
| 4,229,892 | 10/1980 | Hueter et al. | 40/152.1 |
| 4,775,129 | 10/1988 | Gleisten | 248/493 |
| 4,858,871 | 8/1989 | Romano | 248/489 X |
| 4,871,140 | 10/1989 | Hoskinson et al. | 248/496 |

FOREIGN PATENT DOCUMENTS

| | | | |
|---|---|---|---|
| 0191159 | 12/1907 | Fed. Rep. of Germany | 248/301 |
| 0676903 | 8/1952 | United Kingdom | 248/497 |

*Primary Examiner*—Ramon O. Ramirez
*Attorney, Agent, or Firm*—Young & Thompson

[57] ABSTRACT

A device for hanging frames, for example picture frames, overcomes prior art problems wherein string or wire attached to the frame is easily knocked off a nail on the surface, for example a wall, on which the frame is to be hung. In one aspect this is done by providing a hole with converging edges located so that the nail fits snugly between these converging edges, for example in the upper corner of a triangular hole, due to the weight of the frame. The head of the nail overlaps the converging edges of the hole and is therefore held securely. In another aspect, the device has a surface for supporting the wire or string attached to the frame to be hung and provides a substantial area of contact with the string so as to spread the weight of the frame and thereby reduce wear and tear on the wire or string.

6 Claims, 2 Drawing Sheets

DEVICE FOR HANGING FRAMES

FIELD OF THE INVENTION

The present invention relates to a device for hanging frames.

BACKGROUND TO THE INVENTION

Traditionally when a frame, for example carrying a photograph or a picture, is to be hung on a vertical surface such as a wall, a string or wire attached between two points at the back of the frame is balanced over a nail protruding from the wall. The string can easily be knocked off the nail and the small surface area between the nail and the string puts excessive strain on the string making the arrangement unstable and inherently dangerous.

SUMMARY OF THE INVENTION

In one aspect, the present invention provides a device for hanging picture frames or the like comprising a body provided with means for supporting a wire or string of a frame to be hung and a hole having converging edges located so that a protuberance from which the frame is to be suspended is received between the converging edges as a consequence of the weight of the frame.

Preferably the support means is a surface providing a substantial area of contact with the string or wire.

Such a substantial area would be, for example, a multiple of the area of contact between the string and the nail when the device according to the invention is not used.

In another aspect, the present invention provides a device for hanging picture frames or the like comprising a body provided with a support surface for a wire or string supporting a frame to be hung which surface provides a substantial area of contact with the string or wire and means for receiving a protuberance from which the frame is to be suspended.

Preferably, the protuberance receiving means is a hole with converging edges located so that a protuberance, such as a nail or the like from which the frame is to be suspended, is received between the converging edges as a consequence of the weight of the frame.

In a preferred embodiment, the hole is triangular. The body may also be triangular and could be formed from a flat sheet of, for example, metal.

The support surface is preferably a groove which could be formed by sandwiching a rectangular block of metal between the body and a restraining plate.

Alternatively, the support surface can be formed integrally with the body, for example, by bending a cut-out portion of the body.

DESCRIPTION OF DRAWINGS

The invention may be better understood from a detailed description of the following examples with the help of figures, in which.

DETAILED DESCRIPTION

Figure 1B:
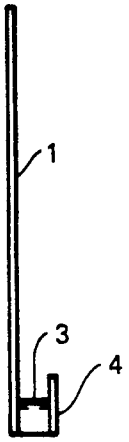
FIGS. 1, 1*b* and 1*a* show one example of a hanger according to the invention in plan, side and bottom views, respectively.
Figure 1:
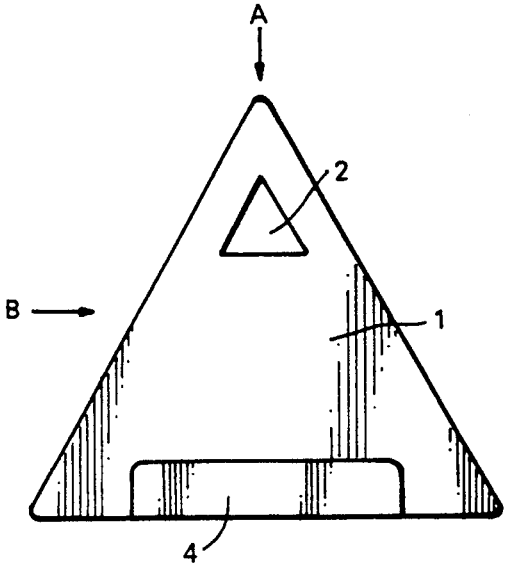
Figure 1A:
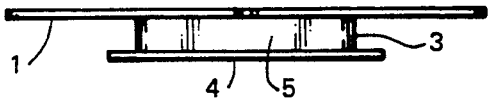

In the example shown in FIG. 1, the hanger is formed from a generally triangular piece of metal 1, cut with a triangular hole 2 in its upper part, and having a groove 3 formed by the block 5 sandwiched between a rectangular plate 4 and the base of the body 1.

Figure 2:
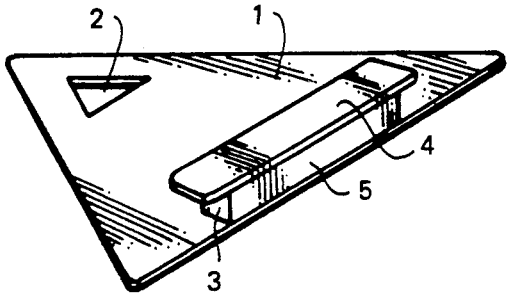
FIGS. 2 and 2*a* are perspective views of the hanger of FIG. 1 and its hook, respectively.
Figure 2A:
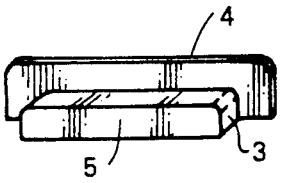

In FIGS. 2 and 2*a*, the perspective view illustrates these features more clearly.

Figure 3:
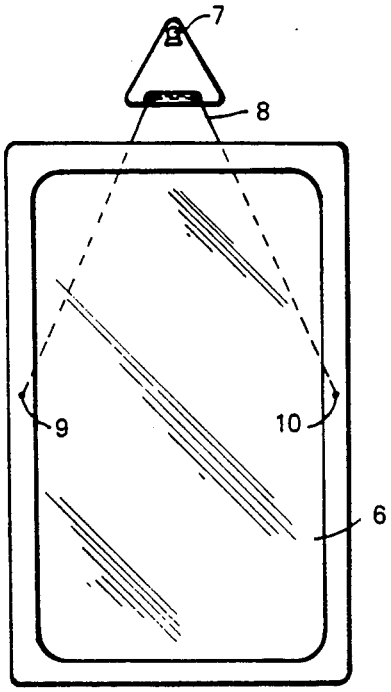
FIG. 3 illustrates the hanger being used to hang a frame on a nail.

FIG. 3 shows how the hanger 1 is used to hang a picture frame 6 onto a nail 7. The nail 7 fits snugly in the upper corner of the triangular hole 2 due to the weight of the frame. It is held securely, even if the nail head is only slightly larger than the nail body, because the head overlaps the converging edges of the hole 2. The hanger 1 will fit a wide variety of nail sizes due to the converging edges of the hole 2. The string 8 attached between points 9 and 10 on the back of the frame 6 is supported on the rectangular block 5 (not visible in FIG. 3). The rectangular plate 4 is longer and deeper than the block 5 so an effective groove is formed for the string 8. This has advantages in safety because the string 8 is not easily dislodged and the weight of the frame 6 is spread over a substantial area along the length of the groove, compared, for example, to hanging the string 8 directly over the nail 7.

In practice, the string 8 would be made short enough so that the hanger 1 is concealed behind the frame 6).

Figure 4B:
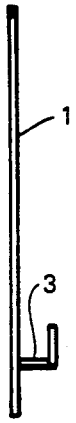
FIGS. 4, 4*a*, 4*b* and 4*c* are views similar to FIGS. 1, 1*a*, 1*b* and 2, respectively, and illustrate another example of a hanger according to the invention.
Figure 4:
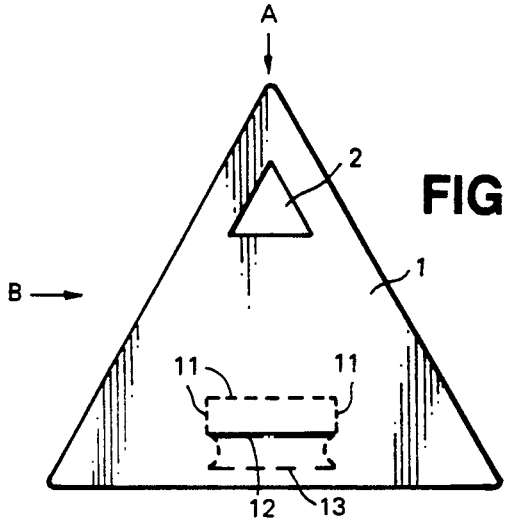
Figure 4A:
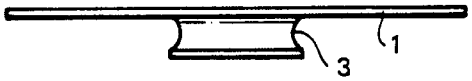

FIG. 4 shows an alternative construction for the groove which consists of cutting the metal 1 along lines 11 and bending it along lines 12 and 13. In this case, groove 3 is integral with the body 1, and a hole 14 is produced in the body 1. This form of construction has cost and speed advantages but the resulting device can only be used for hanging smaller or at least lighter frames.

Figure 5:
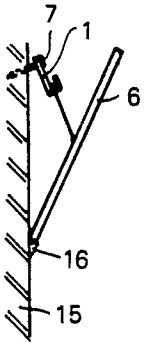
FIG. 5 illustrates another mode of using a hanger according to the invention.
Figure 4C:
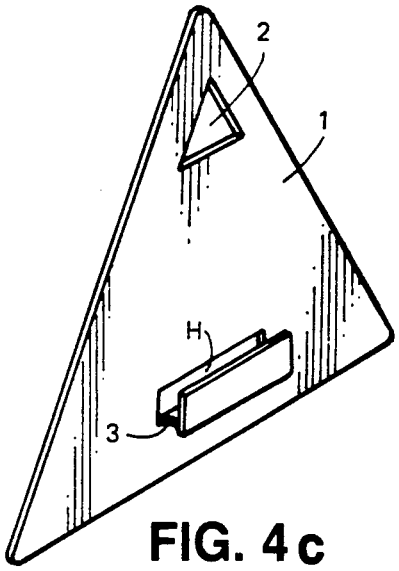

In FIG. 5, a frame 6 is hung against a wall 15 using the device 1. The string 8 attached to the frame 6 is supported in the groove 3 of the device 1. The nail 7 protruding from the wall 15 is received in the hole in the device 1. The frame 6 can be hung at an angle to the wall 15 as shown in FIG. 5 using the device according to the invention. In this case a support 16 is used.

The device is preferably formed from strong metal but could be formed from any suitable material, for example wood or plastic. The limitations would be imposed by the weight of the frame to be hung.

While a particular embodiment of the invention has been shown and described, various modifications are within the true spirit and scope of the invention. The appended claims are, therefore, intended to cover all such modifications.

I claim:

1. A device for interposing between a picture frame having a wire or string affixed and a vertical surface having a protuberance with a head so as to suspend said picture frame from said protuberance, said device comprising a body having an upper portion and a lower portion, said upper portion comprising a hole which is generally triangular in shape with converging edges meeting at an apex extending in a vertical direction, said hole being shaped and dimensioned so that said head of said protuberance passes through said hole and said protuberance is received between said converging edges and as a consequence of the weight of the frame said head is received in said apex at a vertical position where it will not pass back through said hole, and said lower portion of said device comprising a projection comprising a rectangular block secured to the body providing a support surface extending in a direction generally perpendicular to the direction of the convergence of the edges of the hole and said support surface providing a substantial area of contact with said string or wire so as to support said string or wire in a plane displaced from the plane of said hole.

2. A device according to claim 1, wherein the body is formed from a thin sheet of metal material.

3. A device according to claim 1, wherein the support surface is formed as a groove in the rectangular block.

4. A device according to claim 1, further comprising a restraining plate secured to the rectangular block so as to sandwich it between the body and the restraining plate.

5. A device according to claim 1, wherein the support surface is formed integrally with the body.

6. A device according to claim 5, wherein the support surface is formed by bending a cut-out portion of the body.

* * * * *